US010787238B2

(12) United States Patent
Watanabe et al.

(10) Patent No.: US 10,787,238 B2
(45) Date of Patent: Sep. 29, 2020

(54) SHIP HANDLING DEVICE

(71) Applicant: Yanmar Co., Ltd., Osaka-shi, Osaka-fu (JP)

(72) Inventors: Jun Watanabe, Osaka (JP); Gakuji Tamura, Osaka (JP); Koichi Kanda, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 178 days.

(21) Appl. No.: 16/090,480

(22) PCT Filed: Oct. 13, 2016

(86) PCT No.: PCT/JP2016/080442
§ 371 (c)(1),
(2) Date: Oct. 1, 2018

(87) PCT Pub. No.: WO2017/168802
PCT Pub. Date: Oct. 5, 2017

(65) Prior Publication Data

US 2019/0112021 A1 Apr. 18, 2019

(30) Foreign Application Priority Data

Mar. 31, 2016 (JP) ..... 2016-073355

(51) Int. Cl.
*B63H 25/42* (2006.01)
*B63H 21/21* (2006.01)
(Continued)

(52) U.S. Cl.
CPC ..... *B63H 25/42* (2013.01); *B63H 5/08* (2013.01); *B63H 5/16* (2013.01); *B63H 21/21* (2013.01);
(Continued)

(58) Field of Classification Search
CPC ..... B63H 25/42; B63H 21/21; B63H 5/16; B63H 21/213; B63H 25/02; B63H 25/14;
(Continued)

(56) References Cited

U.S. PATENT DOCUMENTS

2010/0121505 A1* 5/2010 Yamazaki ..... G05D 1/0206 701/21
2010/0138083 A1 6/2010 Kaji
(Continued)

FOREIGN PATENT DOCUMENTS

JP 62-008900 A 1/1987
JP 2007-022422 A 2/2007
(Continued)

OTHER PUBLICATIONS

International Search Report dated Dec. 6, 2016 issued in corresponding PCT Application PCT/JP2016/080442 cites the patent documents above.
(Continued)

*Primary Examiner* — Marthe Y Marc-Coleman
(74) *Attorney, Agent, or Firm* — Norton Rose Fulbright US LLP

(57) ABSTRACT

A ship handling device enabling easy turning calibration. With a ship handling device (7), during turning calibration with the ship handling device (7), the joystick lever (10) is turned to rotate the forward-backward propellers (4) on the port and starboard sides of the ship, and the joystick lever (10) is tilted to change a forward-thrust/backward-thrust ratio of the forward-backward propeller (4) on the port or starboard side or to change the rotation speeds. When a calibration execution switch (10*a*) is operated, thrusts generated with the changed forward-thrust backward-thrust ratio are set as correction coefficients, or, among thrusts generated at the changed rotation speeds (Npn, Nsn) of the
(Continued)

forward-backward propellers (4) on the port and starboard sides, thrusts generated by the forward-backward propellers (4) on the port and starboard sides according to the tilting of the joystick lever (10) are set as correction coefficients (Cp, Cs).

4 Claims, 7 Drawing Sheets

(51) Int. Cl.

| | |
|---|---|
| ***B63H 5/16*** | (2006.01) |
| ***B63H 25/02*** | (2006.01) |
| ***B63H 25/24*** | (2006.01) |
| ***B63H 5/08*** | (2006.01) |

(52) U.S. Cl.
CPC ..... *B63H 21/213* (2013.01); *B63H 25/02* (2013.01); *B63H 25/24* (2013.01); *B63H 2021/216* (2013.01); *B63H 2025/026* (2013.01)

(58) Field of Classification Search
CPC ..... B63H 5/08; B63H 2021/216; B63H 2025/026
See application file for complete search history.

(56) References Cited

U.S. PATENT DOCUMENTS

| | | | | |
|---|---|---|---|---|
| 2011/0166724 | A1* | 7/2011 | Hiramatsu ..... | B63H 25/42 701/21 |
| 2012/0231680 | A1* | 9/2012 | Ono ..... | B63H 21/21 440/1 |
| 2014/0156124 | A1 | 6/2014 | Hara et al. | |

FOREIGN PATENT DOCUMENTS

| | | | |
|---|---|---|---|
| JP | 2010-126085 | A | 6/2010 |
| JP | 2012-185154 | A | 9/2012 |
| JP | 2013-014173 | A | 1/2013 |
| WO | 2007030040 | A1 | 3/2007 |

OTHER PUBLICATIONS

European Search Report dated Mar. 25, 2019 issued in corresponding European Application No. 16897019.2 cites the patent documents above.

* cited by examiner

SHIP HANDLING DEVICE

CROSS REFERENCES TO RELATED APPLICATIONS

This application is a national stage application pursuant to 35 U.S.C. § 371 of International Application No. PCT/W2016/080442, filed on Oct. 13, 2016 which claims priority under 35 U.S.C. § 119 to Japanese Patent Application No. 2016-073355 filed on Mar. 31, 2016, the disclosures of which are hereby incorporated by reference in their entireties.

TECHNICAL FIELD

The present invention relates to a ship handling device to be mounted in a ship.

BACKGROUND ART

Heretofore, there has been known a ship (shaft ship) in which driving power is transmitted from prime mover (engine), provided inside a hull, to a forward-backward propeller, provided outside the hull, via a switching clutch and a propeller shaft. Also, there has been known a ship provided with a side thruster for causing the ship to laterally move leftward or rightward to provide higher maneuverability at the time of, e.g., docking. The side thruster is constituted by a propeller which is provided at a location which is close to the bow and which is at or near the center in a left-and-right direction so that the side thruster can generate a thrust in the left-and-right direction.

For a twin-shaft ship including such a side thruster, there has been known a ship handling device enabling easy handling of a ship with use of a joystick lever (see Patent Literature 1 (PTL 1)). With this ship handling device, even for an operator who does not know behavior changes of the hull well, it is possible to easily operate the ship to perform a slow-speed movement such as parallel movement or turning on the spot by operating the joystick lever, which is ship handling means.

Unfortunately, however, a turning center defined to calculate a rotational moment acting on the hull is not always identical to a turning center intended by the operator on the ship. In a case where the ship is operated by different operators, a turning center intended by an operator varies depending on the operator. On this account, the operator might have poor operation feeling.

Such poor operation feeling could be avoided, if each of the operators can appropriately perform calibration for turning (turning calibration) as needed so that the ship can always turn around a turning center intended by the operator. Thus, there has been a demand for a ship handling device enabling easy calibration for turning in order to achieve turning of the ship as desired by each individual operator.

CITATION LIST

Patent Literature

PTL 1: Japanese Patent Application Laid-Open No. 2007-22422

SUMMARY OF INVENTION

Technical Problem

Some aspects of the present invention have an object to provide a ship handling device enabling easy calibration for turning.

Solution to Problem

A ship handling device according to an aspect of the present invention is a ship handling device to be mounted in a ship that includes a forward-backward propeller on a port side coupled to a propeller shaft on the port side and configured to generate a thrust and a forward-backward propeller on a starboard side coupled to a propeller shaft on the starboard side and configured to generate a thrust, the ship handling device including: a joystick lever configured to be turned and tilted and used to determine a traveling speed and a traveling direction of the ship, wherein during calibration for turning performed with the ship handling device, the joystick lever is turned to rotate the forward-backward propellers on the port side and the starboard side, and the joystick lever is tilted to change a forward-thrust/backward-thrust ratio of the forward-backward propeller on the port side or a forward-thrust/backward-thrust ratio of the forward-backward propeller on the starboard side or to change rotation speeds of the forward-backward propellers on the port side and the starboard side, and in a case where an operation tool for executing calibration is operated, the calibration for turning is executed by setting, as correction coefficients, thrusts generated at the forward-thrust/backward-thrust ratio having been changed or by setting, as correction coefficients, thrusts generated by the forward-backward propellers on the port side and the starboard side according to the tilting of the joystick lever, among thrusts generated at the rotation speeds of the forward-backward propellers on the port side and the starboard side having been changed.

A ship handling device according to an aspect of the present invention is a ship handling device to be mounted in a ship that includes a forward-backward propeller on a port side coupled to a propeller shaft on the port side and configured to generate a thrust and a forward-backward propeller on a starboard side coupled to a propeller shaft on the starboard side and configured to generate a thrust, the ship handling device including: a joystick lever configured to be turned and used to determine a turning speed and a turning direction of the ship; and operation means for causing the ship to move forward or backward, wherein during calibration for turning performed with the ship handling device, the joystick lever is turned to rotate the forward-backward propellers on the port side and the starboard side, and predetermined operation of the operation means is performed to change a forward-thrust/backward-thrust ratio of the forward-backward propeller on the port side or a forward-thrust/backward-thrust ratio of the forward-backward propeller on the starboard side or to change rotation speeds of the forward-backward propellers on the port side and the starboard side, and in a case where an operation tool for executing calibration is operated, the calibration for turning is executed by setting, as correction coefficients, thrusts generated at the forward-thrust/backward-thrust ratio having been changed or by setting, as correction coefficients, thrusts generated by the forward-backward propellers on the port side and the starboard side according to the predetermined operation, among thrusts generated at the rotation speeds of the forward-backward propellers on the port side and the starboard side having been changed.

The ship handling device according to the aspect of the present invention is preferably configured such that, in preparation for start of operation of the joystick lever, rudders of the ship are maintained at neutral positions.

Advantageous Effects of Invention

With the ship handling device according to the aspect of the present invention, by turning and tilting of the joystick lever performed in combination, rotation speeds of the forward-backward propellers on the port side and the starboard side measured while turning of the ship as intended by the operator is achieved can be easily determined as rotation speeds to be generated by the forward-backward propellers on the port side and the starboard side in response to turning of the joystick lever. Namely, by performing turning and tilting of the joystick lever in combination, each individual operator on the ship can easily perform calibration for turning. Thus, a ship handling device enabling easy calibration for turning can be provided.

With the ship handling device according to the aspect of the present invention, by turning the joystick lever and performing the predetermined operation of the operation means in combination, rotation speeds of the forward-backward propellers on the port side and the starboard side measured while turning of the ship as intended by the operator is achieved can be easily determined as rotation speeds to be generated by the forward-backward propellers on the port side and the starboard side in response to turning of the joystick lever. Namely, by performing turning of the joystick lever and the predetermined operation of the operation means in combination, each individual operator on the ship can easily perform calibration for turning. Thus, a ship handling device enabling easy calibration for turning can be provided.

With the ship handling device according to the aspect of the present invention, it is possible to achieve determination of suitable correction coefficients.

DESCRIPTION OF EMBODIMENTS

Figure 1:
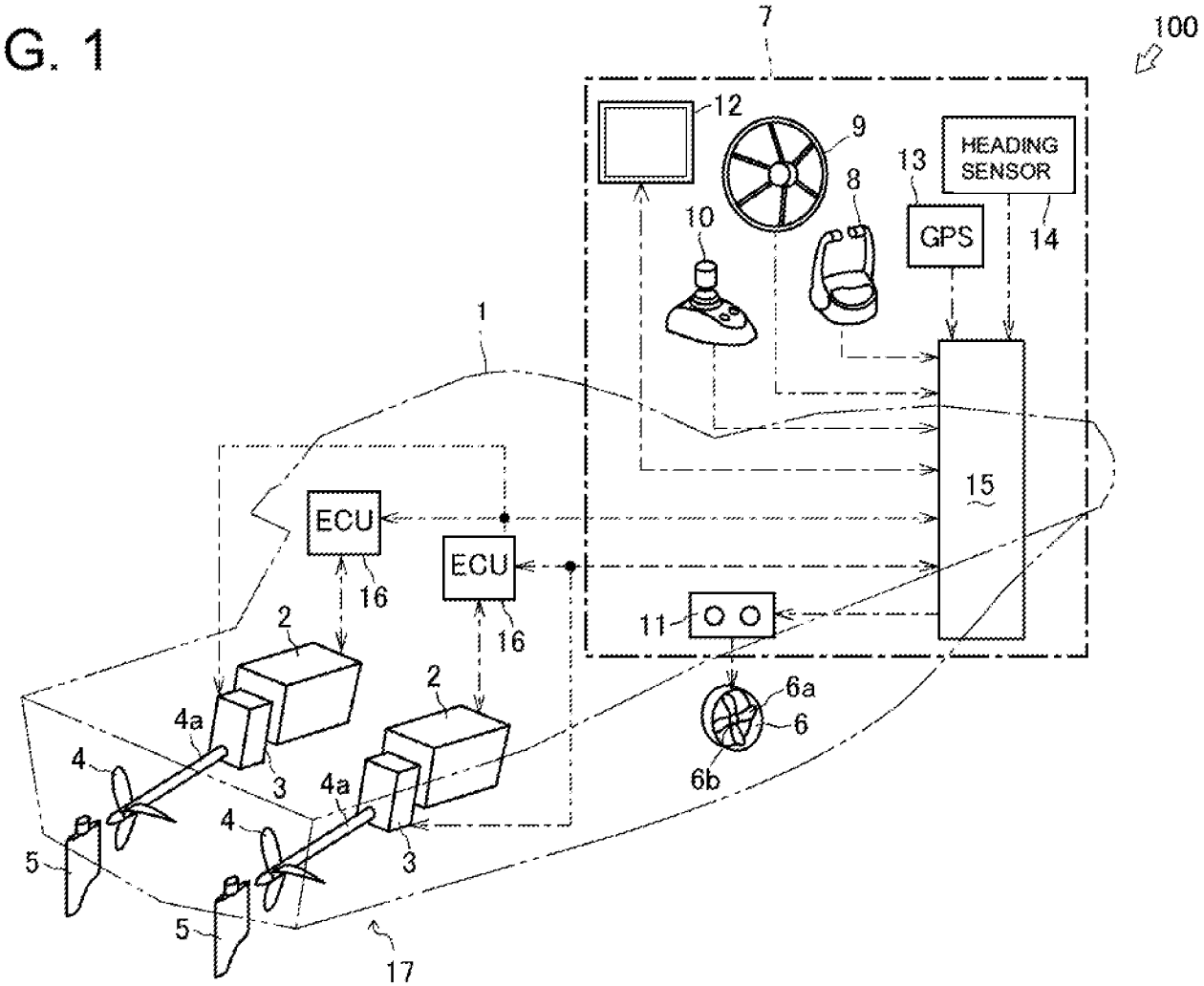
FIG. 1 is a view schematically illustrating an overview of an entire ship provided with a ship handling device according to an aspect of the present invention.

First, with reference to FIGS. 1 to 3, an overview and a configuration of an entire ship 100 provided with a ship handling device 7 will be described. The ship 100 illustrated in FIG. 1 is a ship (shaft ship) of a so-called twin-screw propulsion type. However, the number of propeller shafts and the type of the propulsion device are not limited to those in the above-described ship. Alternatively, the ship 100 may be a ship provided with a plurality of shafts, an outdrive-type ship, or a podded ship. In the following description, a front-and-back direction and a left-and-right direction are defined with a bow direction of the ship 100 being defined as the front.

Figure 2:
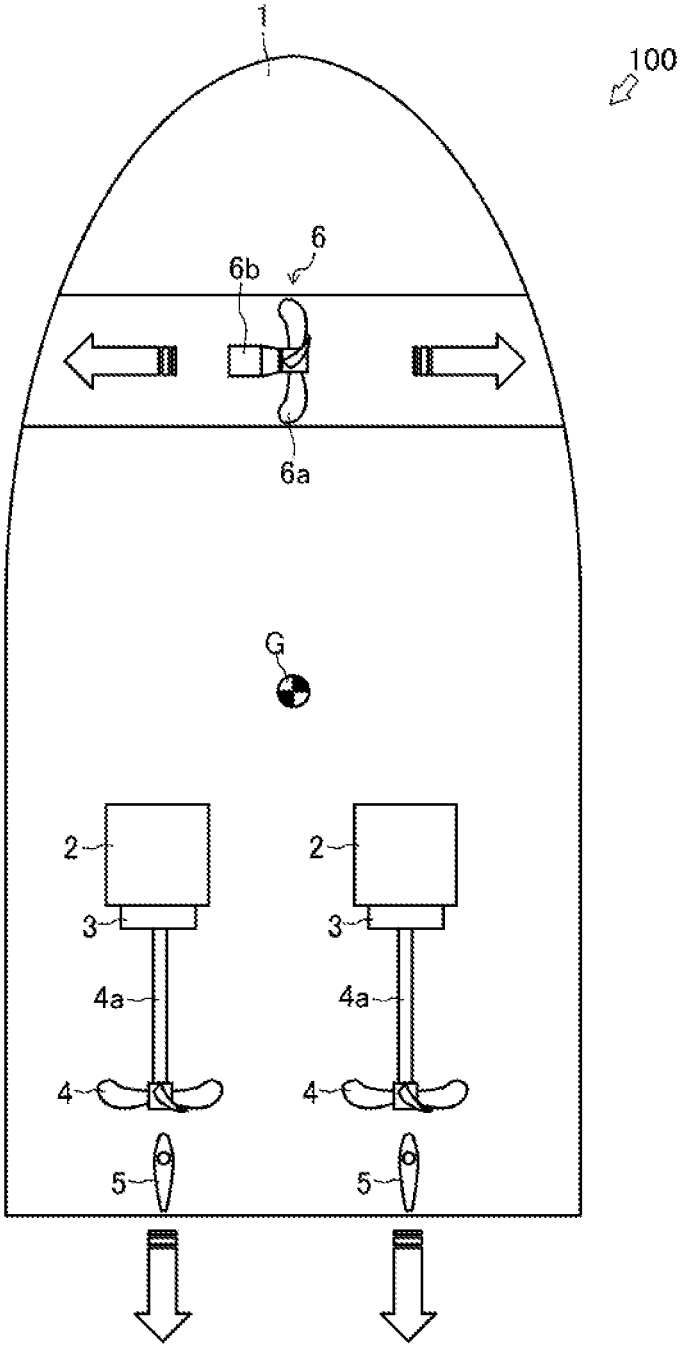
FIG. 2 is a plan view schematically illustrating arrangement of a side thruster and forward-backward propellers of the ship provided with the ship handling device.

As illustrated in FIGS. 1 and 2, the ship 100 is a shaft ship in which driving power from engines 2, which are a driving power source, is transmitted to forward-backward propellers 4 through propeller shafts 4*a*. The ship 100 has a hull 1 provided with a propulsion device 17 and the ship handling device 7. The propulsion device 17 includes the engines 2, switching clutches 3, the forward-backward propellers 4, rudders 5, a side thruster 6, and ECUs 16. The ship handling device 7 includes an accelerator lever 8, a steering wheel 9, a joystick lever 10, a side thruster controller 11, a monitor 12, a global positioning system (GPS) device 13, a heading sensor (orientation sensor) 14, and a ship handling control device 15. In the above description, the ship 100 is the shaft ship including the propulsion device 17 having parts corresponding to a port side and a starboard side of the ship 100, respectively. However, the ship 100 is not limited to such a configuration. Alternatively, the ship 100 may be a stern drive ship or the like. Further alternatively, the ship 100 may be a ship including a podded propulsion device. The thruster is not limited to a bow thruster provided in the bow. Alternatively, the thruster may be a stern thruster provided in the stern.

The two engines 2 each generate driving power for rotating a corresponding one of the forward-backward propellers 4 on the port side and the starboard side. One of the engines 2 is disposed in a rear portion of the port side of the hull 1, and the other of the engines 2 is disposed in a rear portion of the starboard side of the hull 1. The engines 2 each have an output shaft to which a corresponding one of the switching clutches 3 is connected.

The two switching clutches 3 switch the driving power, transmitted from the output shafts of the engines 2, between a forward rotation direction and a reverse rotation direction, and output the resulting driving power. The switching clutches 3 each have an input side connected to a corresponding one of the output parts of the engines 2. The switching clutches 3 each have an output side connected to a corresponding one of the propeller shafts 4*a*. Thus, the switching clutches 3 are each configured to transmit the driving power from a corresponding one of the engines 2 to a corresponding one of the propeller shafts 4*a*.

The two forward-backward propellers 4 each generate a thrust in the front-and-rear direction. The forward-backward propellers 4 are respectively connected to the two propeller shafts 4*a* extending to the outside of the ship through a port-side portion and a starboard-side portion of the bottom of the hull 1. The forward-backward propellers 4 are rotated by the driving power transmitted thereto from the engines 2 via the propeller shafts 4*a*. Multiple blades arranged around a rotating shaft of each of the propeller shafts 4*a* rotate in water in the periphery, so that a thrust is generated.

The two rudders 5 change the direction of a water flow generated by the rotation of the forward-backward propellers 4. One of the rudders 5 is disposed at a location which is in a rear end (stern side) of the port-side portion of the bottom of the hull 1 and which is rearward of a corresponding one of the forward-backward propellers 4. The other of the rudders 5 is disposed at a location which is in a rear end (stern side) of the starboard-side portion of the bottom of the hull 1 and which is rearward of a corresponding one of the forward-backward propellers 4. The rudders 5 are each capable of turning about its corresponding rotating shaft, provided in the hull 1, in a left-and-right direction within a predetermined angle range. The rudders 5 are interlocked and coupled to the steering wheel 9. Thus, the rudders 5 are configured such that, when the steering wheel 9 is operated to cause rear ends of the rudders 5 to be directed rightward of the hull 1, a thrust generated by the resulting water flow presses the stern of the ship 100 leftward to direct the bow of the ship 100 rightward. Similarly, the rudders 5 are configured such that, when the steering wheel 9 is operated to cause the rear ends of the rudders 5 to be directed leftward of the hull 1, a thrust generated by the resulting water flow presses the stern of the ship 100 rightward to direct the bow of the ship 100 leftward.

The side thruster 6 generates a thrust in the left-and-right direction. The side thruster 6 is disposed at a location which is close to the bow of the hull 1 and which is in the center in the left-and-right direction. The side thruster 6 includes a propeller 6*a* and a motor 6*b*. The motor 6*b* is configured to be capable of rotating at a certain rotation speed (unit: rpm). As a result of adjustment of a driving period and a non-driving period of the motor 6*b*, a predetermined thrust is generated by the motor 6*b*. As the driving period of the motor 6*b* increases, a thrust generated by the motor 6*b* increases. The side thruster 6 is configured such that the propeller 6*a* generates a thrust in the left-and-right direction of the hull 1. The side thruster 6 drives the motor 6*b* according to a signal from the side thruster controller 11, so that the propeller 6*a* is rotated to generate a thrust of a desired magnitude in the left-and-right direction. The motor 6*b* may be connected to the side thruster controller 11, and may be rotatable at a desired rotation speed.

The accelerator lever 8 included in the ship handling device 7 generates a signal for a rotation speed (unit: rpm) of the forward-backward propeller 4 on the port side, a signal for a rotation speed (unit: rpm) of the forward-backward propeller 4 on the starboard side, and signals for rotation directions of these forward-backward propellers 4. The accelerator lever 8 includes a lever for the forward-backward propeller 4 on the port side and a lever for the forward-backward propeller 4 on the starboard side. That is, the accelerator lever 8 is configured to independently generate a signal for the forward-backward propeller 4 on the port side and a signal for the forward-backward propeller 4 on the starboard side. The accelerator lever 8 is configured to be tilted at a desired angle in the front-and-rear direction of the ship 100. The accelerator lever 8 is configured to independently generate signals for rotation speeds (unit: rpm) of the engines 2 and signals for switching states of the switching clutches 3 corresponding to the engines 2, based on the direction and the amount of the operation. When the accelerator lever 8 is tilted forward, the accelerator lever 8 generates signals for the forward-backward propellers 4 to generate thrusts for causing the ship 100 to move forward. Meanwhile, when the accelerator lever 8 is tilted rearward, the accelerator lever 8 generates signals for the forward-backward propellers 4 to generate thrusts for causing the ship 100 to move backward.

The steering wheel 9 included in the ship handling device 7 is used to change turning angles of the rudders 5. The steering wheel 9 is interlocked and connected to the rudders 5 on the port side and the starboard side via a hydraulic circuit. When the steering wheel 9 is turned to the right, the rear ends of the rudders 5 are turned to be directed to the right. Consequently, a water flow generated by the forward-backward propellers 4 is directed to the right, so that the stern of the ship 100 is pressed to the left and accordingly the bow of the ship 100 is directed to the right. Similarly, when the steering wheel 9 is turned to the left, the rear ends of the rudders 5 are turned to be directed to the left. Consequently, a water flow generated by the forward-backward propellers 4 is directed to the left, so that the stern of the ship 100 is pressed to the right and accordingly the bow of the ship 100 is directed to the left.

Figure 3:
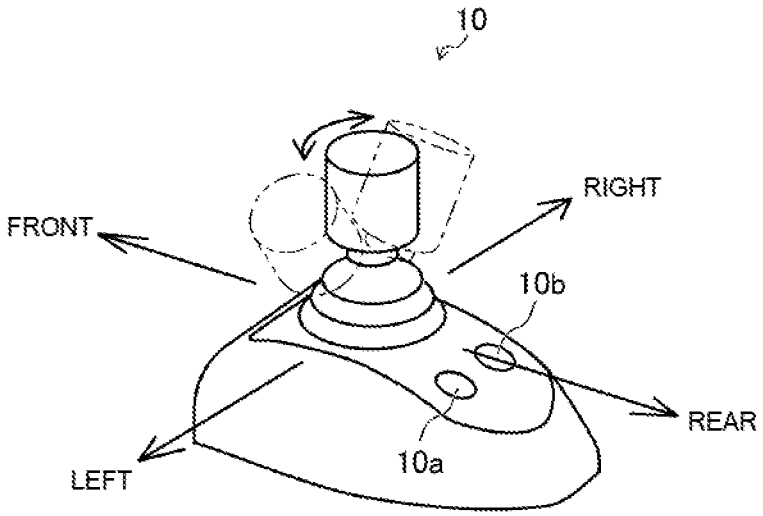
FIG. 3 is a perspective view illustrating a configuration of a joystick lever of the ship handling device.

As illustrated in FIGS. 1 and 3, the joystick lever 10 included in the ship handling device 7 generates a signal for causing the ship 100 to move in a desired direction. The joystick lever 10 can be tilted in a desired direction at a desired angle. The joystick lever 10 can be operated to turn about a lever axis at a desired angle.

The joystick lever 10 is configured to generate, based on the mode and the amount of the operation, signals for rotation speeds of the engines 2 and switching states of the switching clutches 3 and a signal for a driving period of the side thruster 6. Specifically, when the joystick lever 10 is tilted in a desired direction, the joystick lever 10 generates a signal for the forward-backward propellers 4 on both sides and a signal for the side thruster 6 to cause the ship 100 to move in a direction corresponding to the operation with a thrust corresponding to the amount and period of the operation. When the joystick lever 10 is operated to turn about the lever axis, the joystick lever 10 generates signals for the propulsion propellers 4 on both sides to cause the ship 100 to turn in a desired direction with a thrust corresponding to the amount and period of the operation. In this manner, the joystick lever 10 determines a turning speed and a turning direction of the ship 100. In a case where the side thruster 6 has a configuration in which the motor 6*b* (see FIG. 1) can rotate at a desired rotation speed, the joystick lever 10 generates a signal for setting a desired rotation speed of the side thruster 6. In this manner, the joystick lever 10 determines a traveling speed and a traveling direction of the ship 100.

The joystick lever 10 is provided with a calibration execution switch 10*a* for performing calibration for lateral movement, calibration for diagonal movement, and calibration for turning. The calibration execution switch 10*a* is an on-off switch or a tactile switch. The calibration execution switch 10*a* is a switch used to give an instruction to start calibration for lateral movement, diagonal movement, and turning. When the calibration execution switch 10*a* is operated to perform any one of these types of calibration, a correction coefficient is determined based on the control mode of the one of the types of the calibration, and a setting value regarding a rotation speed and/or the like is calculated based on the correction coefficient.

The joystick lever 10 is provided with a lever operation switch 10*b* for enabling ship handling with the joystick lever 10. The lever operation switch 10*b* is an on-off switch or a tactile switch. When the lever operation switch 10*b* is operated and activated by an operator, the ship 100 is brought into a state in which the ship 100 can be handled by the joystick lever 10. When the lever operation switch 10*b* is operated and deactivated by the operator, the ship 100 is brought into a state in which the ship 100 cannot be handled by the joystick lever 10.

The side thruster controller 11 included in the ship handling device 7 is used to drive the side thruster 6. When the side thruster controller 11 is operated to be turned on, the side thruster controller 11 causes the motor 6*b* of the side thruster 6 to rotate in a desired direction so that the propeller 6*a* of the side thruster 6 generates a thrust in the left-and-right direction.

The GPS device 13 included in the ship handling device 7 measures (calculates) positional coordinates of the ship 100. The GPS device 13 receives signals from a plurality of GPS satellites, calculates positional coordinates of the ship 100, and outputs a latitude La (n) and a longitude Lo (n) representing the current position. That is, as a position calculating device, the GPS device 13 calculates absolute values of the positional coordinates of the ship 100.

The heading sensor 14 that is an orientation calculating device included in the ship handling device 7 measures (calculates) a direction of the ship 100. The heading sensor 14 calculates an orientation of the bow of the ship 100 based on information from the GPS device 13. That is, the heading sensor 14 calculates an absolute orientation of the bow of the ship 100.

As illustrated in FIG. 1, each of the ECUs 16 controls a corresponding one of the engines 2. In each of the ECUs 16, various programs and data for controlling a corresponding one of the engines 2 are stored. The ECUs 16 are provided for their respective engines 2. Each of the ECUs 16 may have a configuration in which a CPU, a ROM, a RAM, an HDD and/or the like are connected to each other via a bus, or may have a configuration made of a single-chip LSI and/or the like.

Each of the ECUs 16 is connected to components of a corresponding one of the engines 2, such as a fuel adjustment valve of a fuel supply pump, a fuel injection valve, and various sensors (these components are not illustrated). The ECU 16 is capable of controlling an opening degree of the fuel adjustment valve and opening/closing of the fuel injection valve, and is also capable of obtaining information detected by various sensors.

The ship handling control device 15 included in the ship handling device 7 controls the engines 2, the switching clutches 3, and the side thruster 6 based on detection signals from, e.g., the accelerator lever 8, the steering wheel 9, and the joystick lever 10. The ship handling control device 15 may be configured to be capable of performing so-called automatic navigation that enables automatic handling of the ship along a route calculated from the current position and the preset destination based on the information from the GPS device 13.

In the ship handling control device 15, various programs and data for controlling the engines 2, the switching clutches 3, and the side thruster 6 are stored.

The ship handling control device 15 is connected to the switching clutches 3 and the ECUs 16 of the engines 2, and can obtain information indicative of states of the switching clutches 3, information indicative of operation states of the engines 2, information indicative of engine speeds that the ECUs 16 obtain from various sensors, and various signals that the ECUs 16 obtain from various sensors.

The ship handling control device 15 can transmit, to the switching clutches 3, signals for changing (switching) clutch states.

The ship handling control device 15 can transmit, to the ECUs 16, signals for controlling the fuel adjustment valves of the fuel supply pumps, the fuel injection valves, and other various devices of the engines 2.

The ship handling control device 15 is connected to the accelerator lever 8 and the joystick lever 10, and can obtain signals from the acceleration lever 8 and the joystick lever 10.

The ship handling control device 15 is connected to the side thruster controller 11 of the side thruster 6, and can transmit thereto a signal for controlling the side thruster 6.

The ship handling control device 15 is connected to the GPS device 13 and the heading sensor 14, and can obtain therefrom absolute coordinates and an absolute orientation of the ship 100.

The ship handling control device 15 is connected to the monitor 12, and can cause the monitor 12 to display the current position of the ship 100 and a state of ship handling with the joystick lever 10.

The following will describe calibration for turning performed by the ship handling device 7.

First, the inventors found the fact that, by rotating the forward-backward propellers 4 on the port side and the starboard side in directions opposite to each other at the same rotation speed (i.e., by balancing a forward-thrust/backward-thrust ratio between the forward-backward propellers 4 on the port side and the starboard side) with the rudders 5 on the port side and the starboard side being maintained at neutral positions (i.e., at positions for causing the ship 100 to move straight) and the side thruster 6 not being driven, the ship 100 is caused to turn around a center of gravity G.

Figure 4:
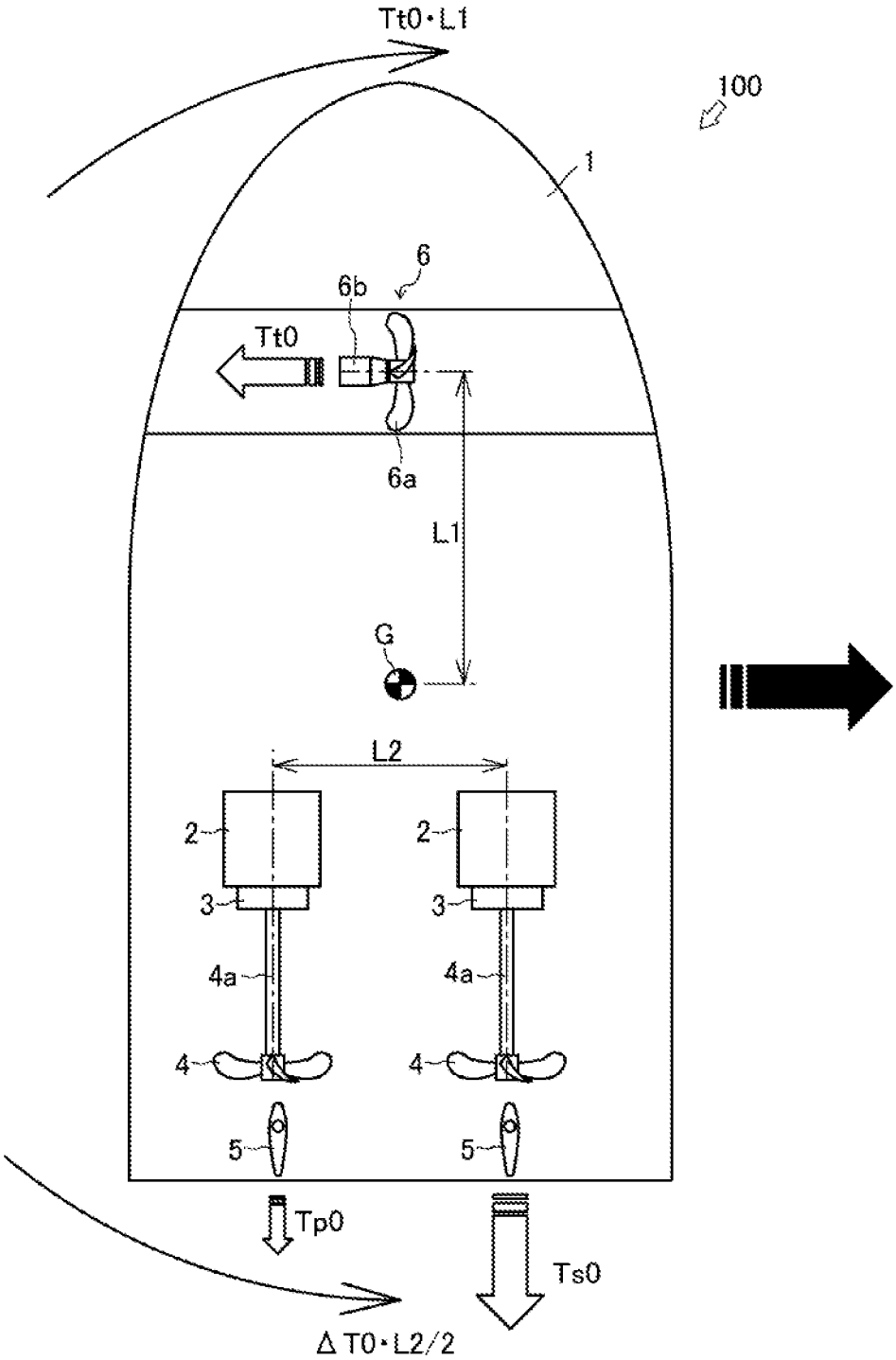
FIG. 4 is a plan view illustrating thrusts generated by the side thruster and the forward-backward propellers while the ship provided with the ship handling device is moving laterally.

FIG. 4 illustrates thrusts generated by the side thruster 6 and the forward-backward propellers 4 on the port side and the starboard side while the ship 100 provided with the ship handling device 7 is moving laterally. As illustrated in FIG. 4, assume that the side thruster 6 and the forward-backward propellers 4 are arranged such that: the side thruster 6 is disposed at a position apart from, by a center-of-gravity distance L1 (i.e., a distance between the side thruster 6 and the center of gravity G), the center of gravity G of the hull 1 of any shape toward the bow; and the forward-backward propellers 4 are respectively disposed on the port side and the starboard side in the bow so as to be apart from each other by an axis-to-axis distance L2.

A balance between moments around the center of gravity of a thrust Tt0 given by the side thruster 6, a thrust Tp0 given by the forward-backward propeller 4 on the port side, and a thrust Ts0 given by the forward-backward propeller 4 on the starboard side in the ship 100 is as shown in Formula 1. A relation between the thrust Tp0 and the thrust Ts0 is as shown in Formulae 2 and 3, where an average of the thrust Tp0 and the thrust Ts0 is represented as a reference thrust T0 and a thrust difference between the thrust Tp0 and the thrust Ts0 is represented as ΔT0. Thus, the thrust difference ΔT0 is represented as a function of a ratio between the center-of-gravity distance L1 and the axis-to-axis distance L2 and the thrust Tt0, as shown in Formula 4.

$$Tt0 \cdot L1 = (Ts0 - Tp0) \cdot L2/2 \quad \text{[Formula 1]}$$

$$Tp0 = T0 - \Delta T0 \quad \text{[Formula 2]}$$

$$Ts0 = T0 + \Delta T0 \quad \text{[Formula 3]}$$

$$\Delta T0 = L1/L2 \cdot Tt0 \quad \text{[Formula 4]}$$

However, a turning center intended by an operator on the ship is not always identical to an actual turning center (i.e., the center of gravity G of the ship 100). For example, a situation as below may arise. That is, although the operator expects that the center of gravity is at, e.g., a position of an operator's seat (not illustrated) or an intermediate position between the bow and the stern, the actual center of gravity G of the hull 1 is at a position deviated from the position expected by the operator, depending on the condition(s) such as the shape of the hull 1, the positions of the engines 2, and/or the amount of the loads. In such a situation, even if the operator steers the ship 100 to turn on the spot, the hull 1 behaves differently from that intended by the operator. In this case, the hull 1 turns on the spot around the center of gravity G of the ship 100, for example. This leads to occurrence of a turning component at a turning center intended by the operator.

In view of this, the inventors sought for a method capable of causing the ship 100 to turn on the spot around a turning center intended by the operator even when the center of gravity G of the hull 1 is at a position deviated from a position that the operator recognizes as the center of gravity G. As a result, the inventors found the fact that, by increasing or decreasing a forward thrust given by one of the forward-backward propellers 4 on the port side and the starboard side that are generating thrusts for causing the ship to turn on the spot around the center of gravity G and decreasing or increasing a backward thrust given by the other of these forward-backward propellers 4 or by changing a forward-thrust/backward-thrust ratio between these forward-backward propellers 4 itself, it is possible to shift, in the front-and-rear direction of the hull 1, the position of the turning center, without causing a turning component in an intended turning center.

Specifically, in a case where a desired turning center is deviated from the center of gravity G of the ship 100 and is located closer to the bow than is the center of gravity G, among rotation speeds of the forward-backward propellers 4 on the port side and the starboard side for causing the ship 100 to turn on the spot, a rotation speed (thrust) of one of the forward-backward propellers 4 that is generating a backward thrust may be increased, and a rotation speed (thrust) of the other of the forward-backward propellers 4 that is generating a forward thrust may be decreased. This allows only an actual turning center to be shifted closer to the bow from the position of the center of gravity G, without causing the ship 100 itself to move forward or backward.

Meanwhile, there may be a case where a turning center intended by the operator is deviated from the center of gravity G and is at a position closer to the stern than is the center of gravity G. In such a case, the adjustment of the rotation speeds of the forward-backward propellers 4 is performed in an opposite manner to the above. Namely, in a case where a desired turning center is deviated from the center of gravity G of the ship 100 and is located at a position closer to the stern than is the center of gravity G, among rotation speeds of the forward-backward propellers 4 on the port side and the starboard side for causing the ship 100 to turn on the spot, a rotation speed (thrust) of one of the forward-backward propellers 4 that is generating a backward thrust may be decreased, and a rotation speed (thrust) of the other of the forward-backward propellers 4 that is generating a forward thrust may be increased. This allows only an actual turning center to be shifted closer to the stern from the position of the center of gravity G, without causing the ship 100 itself to move forward or backward.

In the above-described manner, for each ship 100 provided with the ship handling device 7, the operator can perform, with the ship handling device 7, calibration for thrusts of the forward-backward propellers 4 on the port side and the starboard side generated at the time of turning, to make an actual turning center coincide with a turning center intended by the operator. In addition, the ship handling device 7 can store, for thrusts of the forward-backward propellers 4 on the port side and the starboard side for causing the ship 100 to turn on the spot around the center of gravity G, correction amounts for achieving thrusts of the forward-backward propellers 4 on the port side and the starboard side with which the ship 100 can turn on the spot around a turning center intended by the operator. Once calibration for turning is performed at an arbitrary turning speed, correction amounts determined in this calibration can be used by the ship handling device 7 to perform correction on a turning center in turning at a different turning speed. This makes it possible for the ship 100 to turn around a turning center intended by the operator.

The following will specifically describe procedures for performing calibration in a turning mode for performing calibration for turning.

Note that, in preparation for start of operation of the joystick lever 10, examples of which include operations on the switches 10*a* and 10*b*, the ship handling device 7 causes the rudders 5 on the port side and the starboard side to be maintained at neutral positions (i.e., at positions for causing the ship 100 to move straight).

Figure 5A:
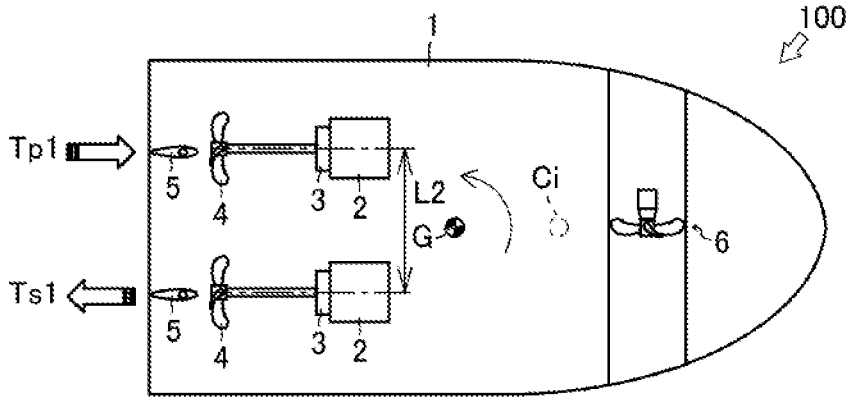
FIG. 5A is a plan view schematically illustrating thrusts generated by the forward-backward propellers on the port side and the starboard side according to turning of the joystick lever.

As illustrated in FIG. 5A, in a case where the ship 100 turns according to turning of the joystick lever 10 around the lever axis, the ship 100 tins according to a direction in which the joystick lever 10 is turned, with a thrust Tp1 given by the forward-backward propeller 4 on the port side and a thrust Ts1 given by the forward-backward propeller 4 on the starboard side, the thrusts corresponding to an amount of the turning of the joystick lever 10 in a clockwise or counter-clockwise direction. Merely by the turning of the joystick lever 10 performed to cause the hull 1 to turn, the motor 6*b* of the side thruster 6 does not rotate, and thus does not generate a thrust. The side thruster 6 generates a thrust corresponding to a period in which the joystick lever 10 is tilted to cause the hull 1 to move diagonally or laterally.

In order to shift an actual turning center from the position of the center of gravity G to an intended turning center (for example, closer to the bow), the joystick lever 10 is turned and also tilted forward at a tilted angle corresponding to an angle at which the ship 100 is caused to turn around the intended turning center. In order to shift an actual turning center closer to the stern, the joystick lever 10 is turned and also tilted rearward at a tilted angle corresponding to an angle at which the ship 100 is caused to turn around the intended turning center.

Figure 5B:
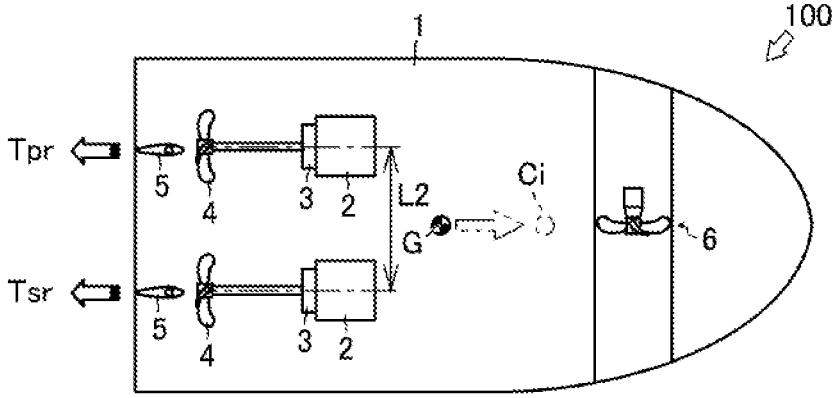
FIG. 5B is a plan view schematically illustrating thrusts generated by the forward-backward propellers on the port side and the starboard side according to tilting of the joystick lever when the joystick lever is turned and tilted.

When the tilting is performed additionally to the turning in the above-described manner, correction amounts Tpr and Tsr for thrusts are vectorially added to the thrusts Tp1 and Ts1 (see FIG. 5A) given by the forward-backward propellers 4 on the port side and the starboard side for causing the ship to turn, as illustrated in FIG. 5B The correction amounts Tpr and Tsr illustrated in FIG. 5B are trusts which cause the ship 100 to move forward and which are set, in order to shift an actual turning center closer to the bow from the position of the center of gravity G, for the thrusts Tp1 and Ts1 given by the forward-backward propellers 4 on the port side and the starboard side for causing the ship 100 to turn on the spot around the center of gravity G.

Figure 5C:
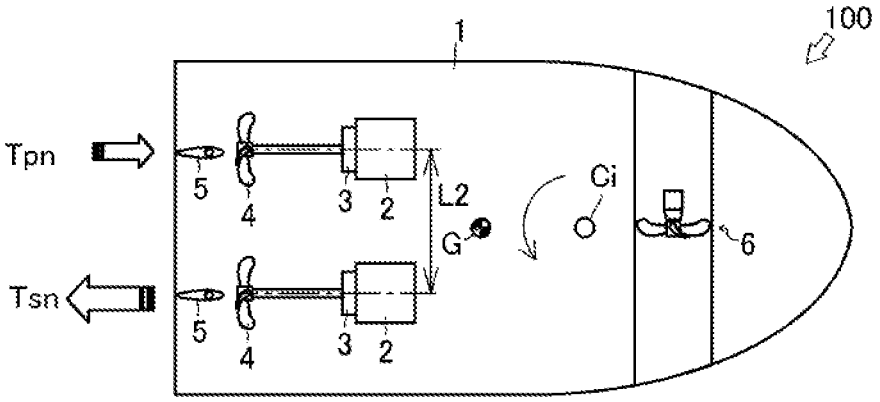
FIG. 5C is a plan view schematically illustrating thrusts generated by the forward-backward propellers on the port side and the starboard side according to turning and tilting of the joystick lever, the tilting having been additionally performed to make the ship turn as intended by an operator.

As a result of addition of such correction amounts Tpr and Tsr to the thrusts Tp1 and Ts1 given by the forward-backward propellers 4 on the port side and the starboard side, the ship turns around a turning center Ci, which is intended by the operator, as illustrated in FIG. 5C. Namely, the ship 100 turns around the turning center Ci with the thrust Tpn given by the forward-backward propeller 4 on the port side and the thrust Tsn given by the forward-backward propeller 4 on the starboard side, the thrusts corresponding to the turning amount and the tilted angle of the joystick lever 10. By shifting, in the front-and-rear direction of the hull 1, the actual turning center from the center of gravity G in this manner, it is possible to make the ship 100 turn on the spot around the turning center Ci, which is intended by the operator.

The ship handling device 7 may be provided with, in addition to the joystick lever 10, another operation means (not illustrated). Instead of the tilting of the joystick lever 10 performed additionally to the turning of the joystick lever 10, operating the above-described another operation means can execute calibration for turning.

For example, during calibration for turning, the monitor 12 (see FIG. 1) of touch-panel type displays arrows respectively indicating front and rear directions of the hull 1 (not illustrated). As a result of touch operation on the arrow indicating the front direction, thrusts given by the forward-backward propellers 4 on the port side and the starboard side are changed into thrusts for causing the ship 100 to move forward. As a result of touch operation on the arrow indicating the rear direction, the thrusts given by the forward-backward propellers 4 on the port side and the starboard side are changed into thrusts for causing the ship 100 to move backward. The touch operation on either of the two arrows performed during calibration for turning corresponds to predetermined operation for causing the ship 100 to move forward or backward.

In addition, in the vicinity of the operator's seat on which the operator can sit, a button for causing the ship 100 to move forward and a button for causing the ship 100 to move backward may be provided (not illustrated). The operation on either of the two buttons performed during calibration for turning corresponds to predetermined operation for causing the ship 100 to move forward or backward.

Next, the following will specifically describe a control mode of calibration for turning performed with the ship handling device 7 including the ship handling control device 15.

Figure 6:
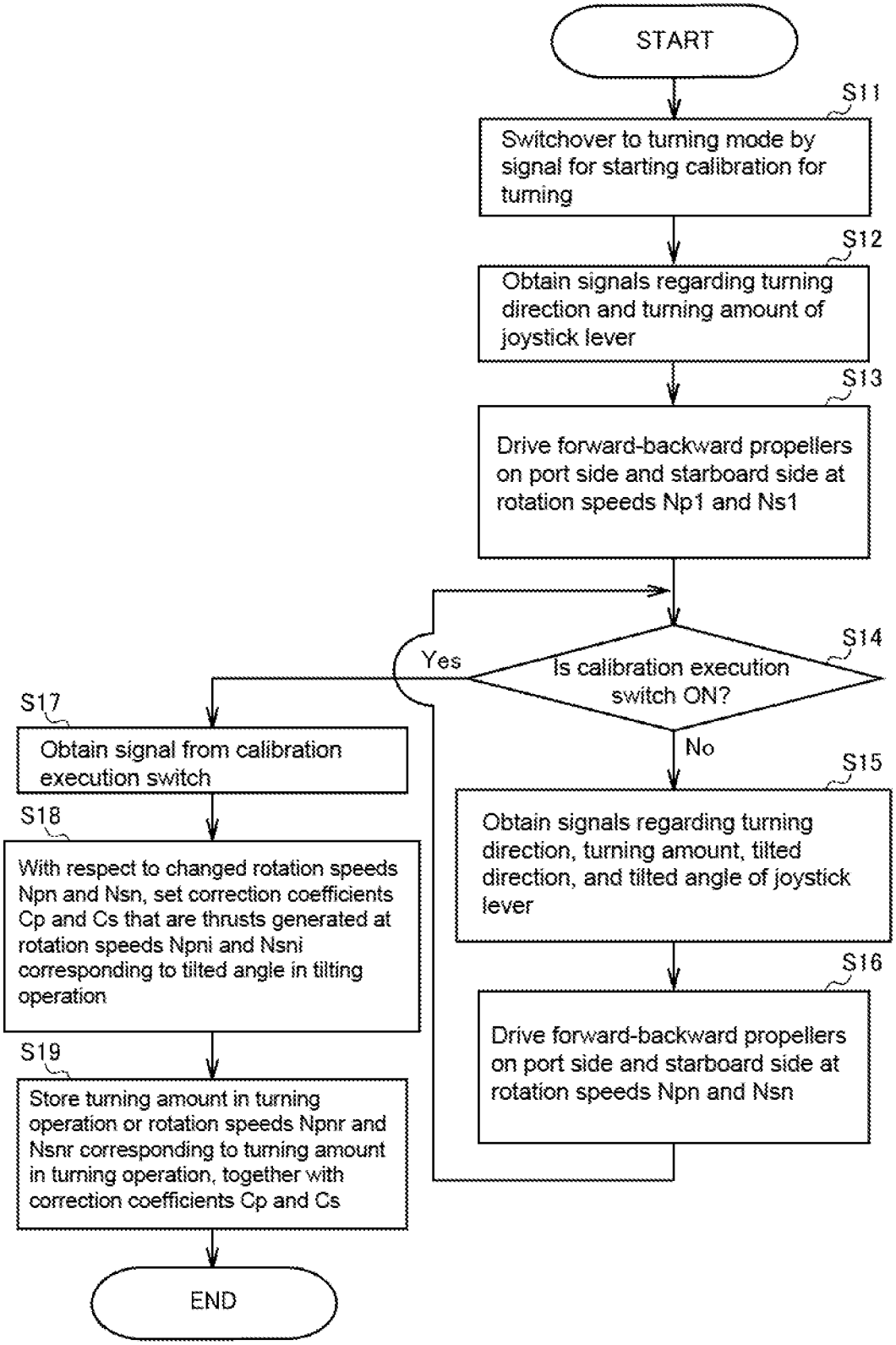
FIG. 6 is a flowchart of a control mode of calibration for turning perforn d in the ship provided with the ship handling device.

As illustrated in FIG. 6, in step S11, upon obtaining of a signal that is transmitted from the joystick lever 10 to give an instruction to start calibration for turning, the ship handling control device 15 switches an operation mode to a mode (referred to as a turning mode) for executing calibration for turning. Then, the ship handling control device 15 causes the process to advance to step S12.

In step S12, at a predetermined time interval, the ship handling control device 15 obtains signals corresponding to a turning direction and a turning amount of the joystick lever 10 that is turned around the lever axis in a clockwise or counterclockwise direction. Then, the ship handling control device 15 causes the process to advance to step S13.

Specifically, the ship handling control device 15 obtains a signal indicating that the joystick lever 10 has been turned. Upon obtaining of this signal, in step S13, according to the turning direction and the turning amount, the ship handling control device 15 causes the forward-backward propeller 4 on the port side to rotate at a rotation speed Np1, at which a thrust Tp1 is generated, and causes the forward-backward propeller 4 on the starboard side to rotate at a rotation speed Ns1, at which a thrust Ts1 is generated, so that a thrust difference ΔT1 occurs between the forward-backward propellers 4 on the port side and the starboard side. Then, in a state where a rotation-speed difference ΔN1 exists, the ship handling control device 15 causes the process to advance to step S14.

In step S14, the ship handling control device 15 determines whether or not the calibration execution switch 10*a* (see FIG. 3) has been operated to be turned on. If the result of this determination is "Yes", the ship handling control device 15 causes the process to advance to step S17. Meanwhile, if the result of this determination is "No", the ship handling control device 15 causes the process to advance to step S15.

In step S15, at a predetermined time interval, the ship handling control device 15 obtains, together with the signals corresponding to the turning direction and the turning amount of the joystick lever 10, signals corresponding to a tilted direction and a tilted angle of the joystick lever 10 that is operated to be tilted. Then, the ship handling control device 15 causes the process to advance to step S16.

There may be a case where operation of the above-described another operation means is performed, instead of the tilting of the joystick lever 10. In such a case, in step S15, at a predetermined time interval, the ship handling control device 15 may alternatively obtain, together with the signals corresponding to the turning direction and the turning amount of the joystick lever 10, a signal corresponding to the operation of the above-described another operation means. After the ship handling control device 15 has obtained the signals, the ship handling control device 15 causes the process to advance to step S16.

Namely, the ship handling control device 15 can obtain, together with the signals corresponding to the turning direction and the turning amount of the joystick lever 10, a signal corresponding to touch operation on the arrow indicating the front direction or a signal corresponding to touch operation on the arrow indicating the rear direction. Alternatively, the ship handling control device 15 may obtain, together with the signals corresponding to the turning direction and the turning amount of the joystick lever 10, a signal corresponding to operation of a button for causing the ship 100 to move forward or a signal corresponding to operation of a button for causing the ship 100 to move backward.

In step S16, according to the turning direction, the turning amount, the tilted direction, and the tilted angle of the joystick lever 10, the ship handling control device 15 causes the forward-backward propeller 4 on the port side to rotate at a rotation speed Npn, at which a thrust Tpn is generated, and causes the forward-backward propeller 4 on the starboard side to rotate at a rotation speed Nsn, at which a thrust Tsn is generated, so that a thrust difference ΔTn occurs between the forward-backward propellers 4 on the port side and the starboard side. In a state where a rotation-speed difference ΔN1 exists, the ship handling control device 15 causes the process to advance to step S14.

The ship handling control device 15 repeatedly performs steps S14 to S16 until the determination "Yes" is made in step S14. Steps S14 to S16 are repeatedly performed, as long as the operator judges that desired turning of the ship is not achieved yet with the turning direction, the turning amount, the tilted direction, and the tilted angle of the joystick lever 10. In other words, signals that the ship handling control device 15 obtains in step S15 in a case where steps S14 to S16 are repeatedly performed are signals for generating thrusts with which the ship turns around a turning center not intended by the operator (or signals for generating a thrust with which the hull 1 moves forward or backward).

Meanwhile, in a case where the operator operates the calibration execution switch 10*a* when the operator judges that the desired turning of the ship has been achieved with the turning direction and the turning amount of the joystick lever 10 or with the turning direction, the turning amount, the tilted direction, and the tilted angle of the joystick lever 10, the ship handling control device 15 can make the determination "Yes" in step S14. Namely, signals that the ship handling control device 15 obtains in step S12 or S15 when the ship handling control device 15 makes the determination "Yes" in step S14 are signals for generating thrusts with which the desired turning of the ship can be achieved, i.e., signals for generating thrusts with which the ship turns around a turning center Ci, which is intended by the operator.

In the above-described manner, in steps S12 to S16, the ship handling device 7 causes the forward-backward propellers 4 on the port side and the starboard side to rotate according to the turning amount of the joystick lever 10 that is operated to be turned, and changes the rotation speeds of the forward-backward propellers 4 on the port side and the starboard side according to the tilted angle of the joystick lever 10 that is operated to cause the ship 100 to turn around the desired turning center Ci.

In step S17, the ship handling control device 15 obtains a signal from the calibration execution switch 10*a*. Then, the ship handling control device 15 causes the process to advance to step S18.

In step S18, with respect to the rotation speed Npn of the forward-backward propeller 4 on the port side achieved at the time when the determination was made in step S14 or at the time when the signal was obtained in step S17, the ship handling control device 15 sets, as a correction value, a rotation speed Npni of the forward-backward propeller 4 on the port side, the rotation speed Npni corresponding to the tilted angle of the joystick lever 10 observed at the time when the determination was made in step S14 or at the time when the signal was obtained in step S17. Also, with respect to the rotation speed Nsn of the forward-backward propeller 4 on the starboard side achieved at the time when the determination was made in step S14 or at the time when the signal was obtained in step S17, the ship handling control device 15 sets, as a correction value, a rotation speed Nsni of the forward-backward propeller 4 on the starboard side, the rotation speed Nsni corresponding to the tilted angle of the joystick lever 10 observed at the time when the determination was made in step S14 or at the time when the signal was obtained in step S17.

In other words, the ship handling control device 15 selects, among thrusts generated at the rotation speeds Npn and Nsn of the forward-backward propellers 4 on the port side and the starboard side, thrusts generated at the rotation speeds Npni and Nsni of the forward-backward propellers 4 on the port side and the starboard side, the rotation speeds Npni and Nsni corresponding to the tilted angle of the joystick lever 10 observed at the time when the determination was made in step S14 or at the time when the signal was obtained in step S17. Then, the ship handling control device 15 sets the selected thrusts as correction coefficients Cp and Cs, which are used to shift the turning center. As described above, in response to turning and tilting of the joystick lever 10 performed in combination, the ship handling device 7 causes generation of thrusts which correspond to rotation speeds Npn and Nsn of the forward-backward propellers 4 on the port side and the starboard side and which are necessary to achieve the desired turning of the ship, and then sets suitable correction coefficients Cp and Cs based thereon. After step S18, the ship handling control device 15 causes the process to advance to step S19.

In step S19, the ship handling control device 15 stores, together with the correction coefficients Cp and Cs thus set, the turning amount of the joystick lever 10 observed at the time when the determination was made in step S14 or at the time when the signal was obtained in step S17 or the rotation speeds Npnr and Nsnr of the forward-backward propellers 4 on the port side and the starboard side, the rotation speeds Npnr and Nsnr corresponding to the turning amount of the joystick lever 10 observed at the time when the determination was made in step S14 or at the time when the signal was obtained in step S17. Then, the ship handling control device 15 ends the process.

There may be a case where the process goes through steps S11 to S14 and then advances to step S17, not through steps S15 and S16. In such a case, in step S19, the ship handling control device 15 stores, as correction coefficients Cp and Cs, thrusts generated at the rotation speeds Np1 and Ns1 of the forward-backward propellers 4 on the port side and the starboard side, the rotation speeds Np1 and Ns1 corresponding to the turning amount of the joystick lever 10 observed at the time when the signals were obtained in step S12 or at the time when the determination was made in step S14. At this time, the ship handling control device 15 also stores this turning amount of the joystick lever 10.

After the calibration for turning has been completed, when the joystick lever 10 is turned, the ship handling device 7 uses the correction coefficients Cp and Cs to cause generation of thrusts according to the rotation speeds of the forward-backward propellers 4 on the port side and the starboard side, the rotation speeds corresponding to the turning amount of the joystick lever 10 that is operated to be turned. Specifically, the ship handling control device 15 adds a function including a fixed correction coefficient Cp to an uncalibrated rotation speed of the forward-backward propeller 4 on the port side, the uncalibrated rotation speed corresponding to an arbitrary turning amount of the joystick lever 10 that is operated to be turned. In this manner, the ship handling control device 15 changes the rotation speed of the forward-backward propeller 4 on the port side. Also, the ship handling control device 15 adds a function including a fixed correction coefficient Cs to an uncalibrated rotation speed of the forward-backward propeller 4 on the starboard side, the uncalibrated rotation speed corresponding to an arbitrary turning amount of the joystick lever 10 that is operated to be turned. In this manner, the ship handling control device 15 changes the rotation speed of the forward-backward propeller 4 on the starboard side.

In other words, the ship handling control device 15 vectorially adds the functions including the correction coefficients Cp and Cs to thrusts generated at the uncalibrated rotation speeds of the forward-backward propellers on the port side and the starboard side, respectively, the uncalibrated rotation speeds corresponding to the arbitrary turning amount of the joystick lever 10 that is operated to be turned. In this manner, the ship handling control device 15 changes the thrusts given by the forward-backward propellers 4 on the port side and the starboard side. As described above, with use of the correction coefficients Cp an Cs, the ship handling control device 15 can change the rotation speeds of the forward-backward propellers 4 on the port side and the starboard side according to a change in turning amount of the joystick lever 10.

There may be a case where the process goes through steps S11 to S14 and then advances to step S17, not through steps S15 and S16. In such a case, the ship handling control device 15 uses again the uncalibrated rotation speeds of the forward-backward propellers on the port side and the starboard side, the uncalibrated rotation speeds corresponding to the turning amount of the joystick lever 10 that is operated to be turned.

Alternatively, calibration for turning can be performed by changing a forward-thrust/backward-thrust ratio between the port side and the starboard side. The forward-thrust/backward-thrust ratio refers to a ratio of a backward thrust to a forward thrust.

Specifically, in a case where a desired turning center is deviated from the center of gravity G of the ship 100 and is located at a position closer to the bow than is the center of gravity G, among rotation speeds of the forward-backward propellers 4 on the port side and the starboard side for causing the ship 100 to turn on the spot, a backward thrust generated by one of the forward-backward propeller 4 may be increased, or a forward thrust generated by the other of the forward-backward propellers 4 may be decreased, so that the forward-thrust/backward-thrust ratio is changed. This allows only an actual turning center to be shifted closer to the bow from the position of the center of gravity G, without causing the ship 100 itself to move forward or backward. Meanwhile, in a case where a desired turning center is deviated from the center of gravity G of the ship 100 and is located at a position closer to the stern than is the center of gravity G, among rotation speeds of the forward-backward propellers 4 on the port side and the starboard side for causing the ship 100 to turn on the spot, a backward thrust generated by one of the forward-backward propeller 4 may be decreased, or a forward thrust generated by the other of the forward-backward propellers 4 may be increased, so that the forward-thrust/backward-thrust ratio is changed. This allows only an actual turning center to be shifted closer to the stern from the position of the center of gravity G, without causing the ship 100 itself to move forward or backward.

Figure 7A:
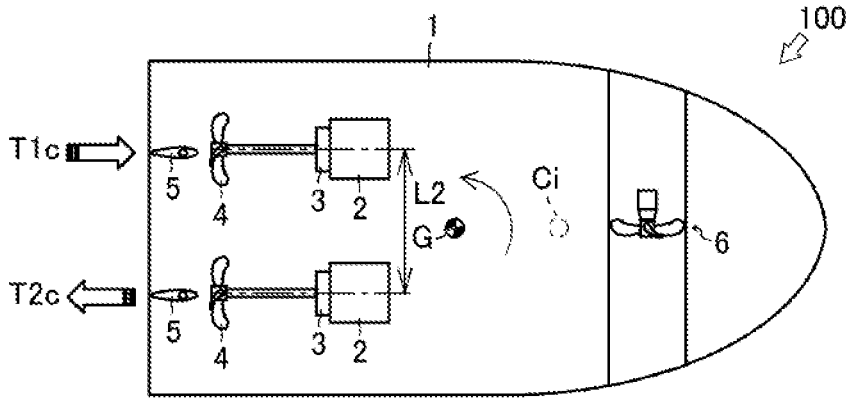
FIG. 7A is a plan view schematically illustrating thrusts generated by the forward-backward propellers on the port side and the starboard side according to turning of the joystick lever.

As illustrated in FIG. 7A, in a case where the ship 100 turns according to turning of the joystick lever 10 around the lever axis, the ship 100 turns according to a direction in which the joystick lever 10 is turned, with a thrust T1*c* given by the forward-backward propeller 4 on the port side and a thrust T2*c* given by the forward-backward propeller 4 on the starboard side, the thrusts corresponding to an amount of the turning of the joystick lever 10 in a clockwise or counterclockwise direction.

In order to shift an actual turning center from the position of the center of gravity G to an intended turning center (for example, closer to the bow) or to shift the actual turning center closer to the stern, the joystick lever 10 is turned and also tilted at a tilted angle corresponding to an angle at which the ship 100 is to turn around the intended turning center.

Figure 7B:
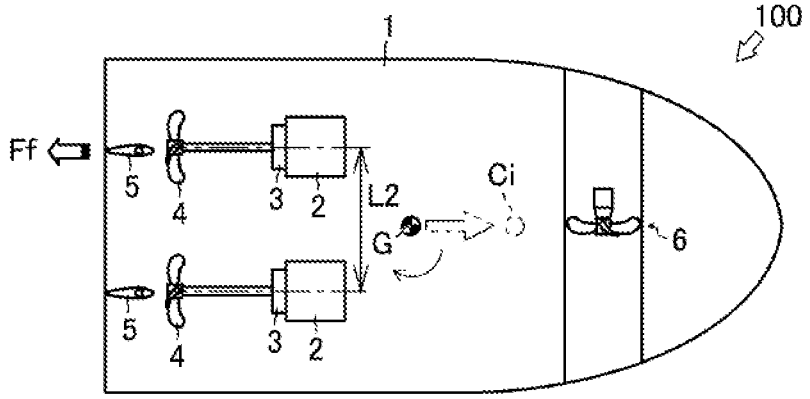
FIG. 7B is a plan view schematically illustrating a turning moment and thrusts generated by the forward-backward propellers on the port side and the starboard side according to tilting of the joystick lever when the joystick lever is turned and tilted.

As illustrated in FIG. 7B, when the joystick lever 10 is tilted, additionally to the turning, to shift the actual turning center closer to the bow, a similar effect to that achieved when a thrust is additionally applied to only one of the port side and the starboard side is achieved. Namely, a correction amount Ff is vectorially added to either of thrusts T1*c* and T2*c* for turning (see FIG. 7A) given by the forward-backward propellers 4 on the port side and the starboard side. Consequently, the thrusts given by the forward-backward propellers 4 on the port side and the starboard side and a turning moment of the hull 1 after the tilting of the joystick lever 10 is performed additionally to the turning of the joystick lever 10 are different from those of before.

Figure 7C:
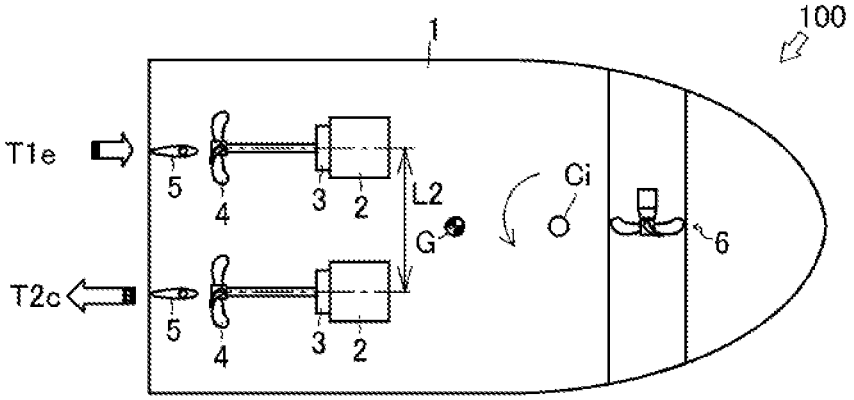
FIG. 7C is a plan view schematically illustrating thrusts generated by the forward-backward propellers on the port side and the starboard side according to turning and tilting of the joystick lever, the tilting having been additionally performed to make the ship turn as intended by an operator.

As a result of the vectorial addition of such a correction amount Ff to the thrust T1*c* of the forward-backward propeller 4 on the port side for the purpose of changing the forward-thrust/backward-thrust ratio, the forward-backward propeller 4 on the port side generates a thrust T1*e*, which has been changed from the thrust T1*c*, as illustrated in FIG. 7C. At the forward-thrust/backward-thrust ratio thus changed, the ship 100 can turn around the turning center Ci, which is intended by the operator. Alternatively, instead of the addition of the correction amount Ff to the thrust T1*c* of the forward-backward propeller 4 on the port side, the correction amount Ff may be subtracted from the thrust T2*c* of the forward-backward propeller 4 on the starboard side. Also in this case, the forward-thrust/backward-thrust ratio is changed, and consequently the ship 100 can turn around the turning center Ci, which is intended by the operator.

The ship handling control device 15 sets, as a correction coefficient, a thrust (i.e., the correction amount Ff) generated at the forward-thrust/backward-thrust ratio thus changed, and stores this correction coefficient. After the calibration for turning is completed, the ship handling control device 15 vectorially adds a function including this correction coefficient to either one of thrusts generated at uncalibrated rotation speeds of the forward-backward propellers on the port side and the starboard side, the uncalibrated rotation speeds corresponding to an arbitrary turning amount of the joystick lever 10 that is operated to be turned. In this manner, the ship handling control device 15 changes the thrust given by the one of the forward-backward propellers 4.

Note that the operation for causing the ship 100 to move forward or backward is not limited to the tilting of the joystick lever 10. Alternatively, the operation for causing the ship 100 to move forward or backward may be predetermined operation of the above-described operation means.

With each of the above-described configurations, calibration for turning can be easily performed so that turning of the ship as desired by each individual operator on the ship can be achieved. Consequently, each individual operator can easily achieve the desired turning of the ship 100 even if he/she does not recognize the position of the center of gravity G of the ship 100, the shape of the hull 1, and the like.

INDUSTRIAL APPLICABILITY

The present invention is applicable to a ship handling device.

REFERENCE SIGNS LIST

1 hull
2 engine
4 forward-backward propeller
4*a* propeller shaft

6 side thruster
7 ship handling device
10 joystick lever
10*a* calibration execution switch (operation tool)
15 ship handling control device
100 ship

The invention claimed is:

1. A ship handling device to be mounted in a ship, the device including a forward-backward propeller, which is on a port side of the ship, coupled to a propeller shaft on the port side and configured to generate a thrust, and a forward-backward propeller, which is on a starboard side of the ship, coupled to a propeller shaft on the starboard side and configured to generate a thrust, said ship handling device comprising:

a joystick lever configured to be turned and tilted and used to determine a traveling speed and a traveling direction of the ship, wherein during calibration for turning performed with the ship handling device, the joystick lever is turned to rotate the forward-backward propellers on the port side and the starboard side, and the joystick lever is tilted to change a forward-thrust/backward-thrust ratio of the forward-backward propeller on the port side or a forward-thrust/backward-thrust ratio of the forward-backward propeller on the starboard side or to change rotation speeds of the forward-backward propellers on the port side and the starboard side, and in a case where an operation tool for executing the calibration is operated, the calibration for turning is executed by setting, as correction coefficients, thrusts generated at the forward-thrust/backward-thrust ratio having been changed or by setting, as correction coefficients, thrusts generated by the forward-backward propellers on the port side and the starboard side according to the tilting of the joystick lever, among thrusts generated at the rotation speeds of the forward-backward propellers on the port side and the starboard side that have been changed.

2. The ship handling device according to claim 1, wherein, in preparation for a start of operation of the joystick lever, rudders of the ship are maintained at neutral positions.

3. A ship handling device to be mounted in a ship, the device including a forward-backward propeller, which is on a port side of the ship, coupled to a propeller shaft on the port side and configured to generate a thrust, and a forward-backward propeller, which is on a starboard side of the ship, coupled to a propeller shaft on the starboard side and configured to generate a thrust, said ship handling device comprising:

a joystick lever configured to be turned and used to determine a turning speed and a turning direction of the ship; and operation means for causing the ship to move forward or backward, wherein during calibration for turning performed with the ship handling device, the joystick lever is turned to rotate the forward-backward propellers on the port side and the starboard side, and a predetermined operation of the operation means is performed to change a forward-thrust/backward-thrust ratio of the forward-backward propeller on the port side or a forward-thrust/backward-thrust ratio of the forward-backward propeller on the starboard side or to change rotation speeds of the forward-backward propellers on the port side and the starboard side, and in a case where an operation tool for executing the calibration is operated, the calibration for turning is executed by setting, as correction coefficients, thrusts generated at the forward-thrust/backward-thrust ratio having been changed or by setting, as correction coefficients, thrusts generated by the forward-backward propellers on the port side and the starboard side according to the predetermined operation, among thrusts generated at the rotation speeds of the forward-backward propellers on the port side and the starboard side that have been changed.

4. The ship handling device according to claim 3, wherein, in preparation for a start of operation of the joystick lever, rudders of the ship are maintained at neutral positions.

* * * * *